US005406812A

United States Patent [19]

Jaw

[11] Patent Number: 5,406,812

[45] Date of Patent: Apr. 18, 1995

[54] STRUCTURE OF BICYCLE LOCK

[76] Inventor: Chin-Woei Jaw, No. 32, Alley 8, Lane 65, Chang-Yuan St., San-Chung City, Taipei, Taiwan, Prov. of China

[21] Appl. No.: 242,970

[22] Filed: May 16, 1994

[51] Int. Cl.[6] ..... E05B 67/22

[52] U.S. Cl. ..... 70/38 A; 70/39; 70/233

[58] Field of Search ..... 70/233, 38 A, 38 R, 70/39, 24, 25, 26, 51, 38 B

[56] References Cited

U.S. PATENT DOCUMENTS

| | | | |
|---|---|---|---|
| 3,967,475 | 7/1976 | Zane | 70/18 |
| 4,085,600 | 4/1978 | Bindari | 70/51 |
| 4,621,509 | 11/1986 | Mizuno | 70/26 |
| 4,881,387 | 11/1989 | Kortenbrede | 70/39 |
| 4,918,949 | 4/1990 | Newbold | 70/38 A |
| 4,987,753 | 3/1991 | Kuo | 70/39 |
| 5,092,142 | 3/1992 | Zane et al. | 70/233 |
| 5,142,888 | 9/1992 | Ling | 70/26 |
| 5,195,340 | 3/1993 | Huang | 70/38 A |
| 5,199,282 | 4/1993 | Wang | 70/38 A |
| 5,331,830 | 7/1994 | Su | 70/38 A |

*Primary Examiner*—Peter M. Cuomo
*Assistant Examiner*—Darnell M. Boucher
*Attorney, Agent, or Firm*—Bacon & Thomas

[57] ABSTRACT

A bicycle lock, which includes a lock case, a shackle having two heads at two opposite ends thereof releasably inserted into respective openings on the lock case, a shackle locking plate revolvably received inside the lock case to automatically lock the shackle upon the insertion of the heads of the shackle into the openings on the lock case, a constraint mechanism to hold the shackle locking plate in the locking position, and a lock cylinder driven to release the shackle locking plate from the shackle for permitting the shackle to be removed from the lock case.

6 Claims, 6 Drawing Sheets

STRUCTURE OF BICYCLE LOCK

BACKGROUND OF THE INVENTION

The present invention relates to lock devices, and more particularly relates to a lock for locking a bicycle or motorcycle.

Various lock devices are known for bicycles and motorcycles. For example, U.S. patent application Ser. No. 07/514,175, filed on Apr. 25, 1990, discloses an improved bicycle lock which comprises a lock case, and a shackle inserted through the object to be locked and having two opposite ends fastened to the lock case. The drawback of this structure of bicycle lock is that the locking procedure as well as the unlocking procedure must be done by means of the control of the key because the locking mechanism inside the lock case cannot automatically lock the shackle upon the insertion of the two opposite ends of the shackle into respective openings on the lock case. Similar lock devices are known from U.S. Pat. Nos. 3,924,426; 3,967,475; 4,085,600; 4,881,387. These lock devices, except U.S. Pat. No. 4,881,387, do not eliminate the aforesaid drawback. The shackle lock of U.S. Pat. No. 4,881,387 can automatically lock the shackle in the locking position upon its insertion into the lock body, however its complicated structure complicates the manufacturing and assembly process and greatly increases the manufacturing cost. Furthermore, neither of the aforesaid lock devices has means to automatically push the shackle outwards from the lock case or lock body when unlocked.

SUMMARY OF THE INVENTION

The present invention has been accomplished to provide a bicycle lock which eliminates the aforesaid drawbacks. According to one aspect of the present invention, the bicycle lock comprises a lock case having two openings spaced at one side, a shackle having two heads at two opposite ends thereof releasably inserted into the openings on the lock case, a shackle locking plate revolvably received inside the lock case to automatically lock the shackle upon the insertion of the heads of the shackle into the openings on the lock case, a constraint mechanism fastened to the lock case at one end to hold the shackle locking plate in the locking position by means of the operation of a spiral spring thereof, and a lock cylinder driven to release the shackle locking plate from the shackle for permitting the shackle to be removed from the lock case.

According to another aspect of the present invention, the heads of the shackle have each a neck for locking by the shackle locking plate, and a conical plug portion longitudinally extended from the neck for inserting into either opening on the lock case; the shackle locking plate has two shackle neck engaging portions for engaging either neck of the shackle, and two release portions with a respective sloping surface for pushing the the conical plug portion of either head of the shackle upwards toward the respective opening on the lock case.

According to still another aspect of the present invention, the lock case has two small holes spaced at an opposite side and respectively aligned with the two openings thereof for receiving the bottom end of the conical plug portion of either head of the shackle.

According to still another aspect of the present invention the constraint mechanism comprises a headed locating bolt fixed to the lock case at one end, a spiral spring mounted around the headed locating bolt, and a clamp fastened to the headed locating bolt to stop the spiral spring against axial movement, wherein the spiral spring has one end fixed to the headed locating bolt and an opposite end hooked on one end of the shackle locking plate to keep the shackle locking plate at the locking position.

DETAILED DESCRIPTION OF THE PREFERRED EMBODIMENT

Figure 1A:
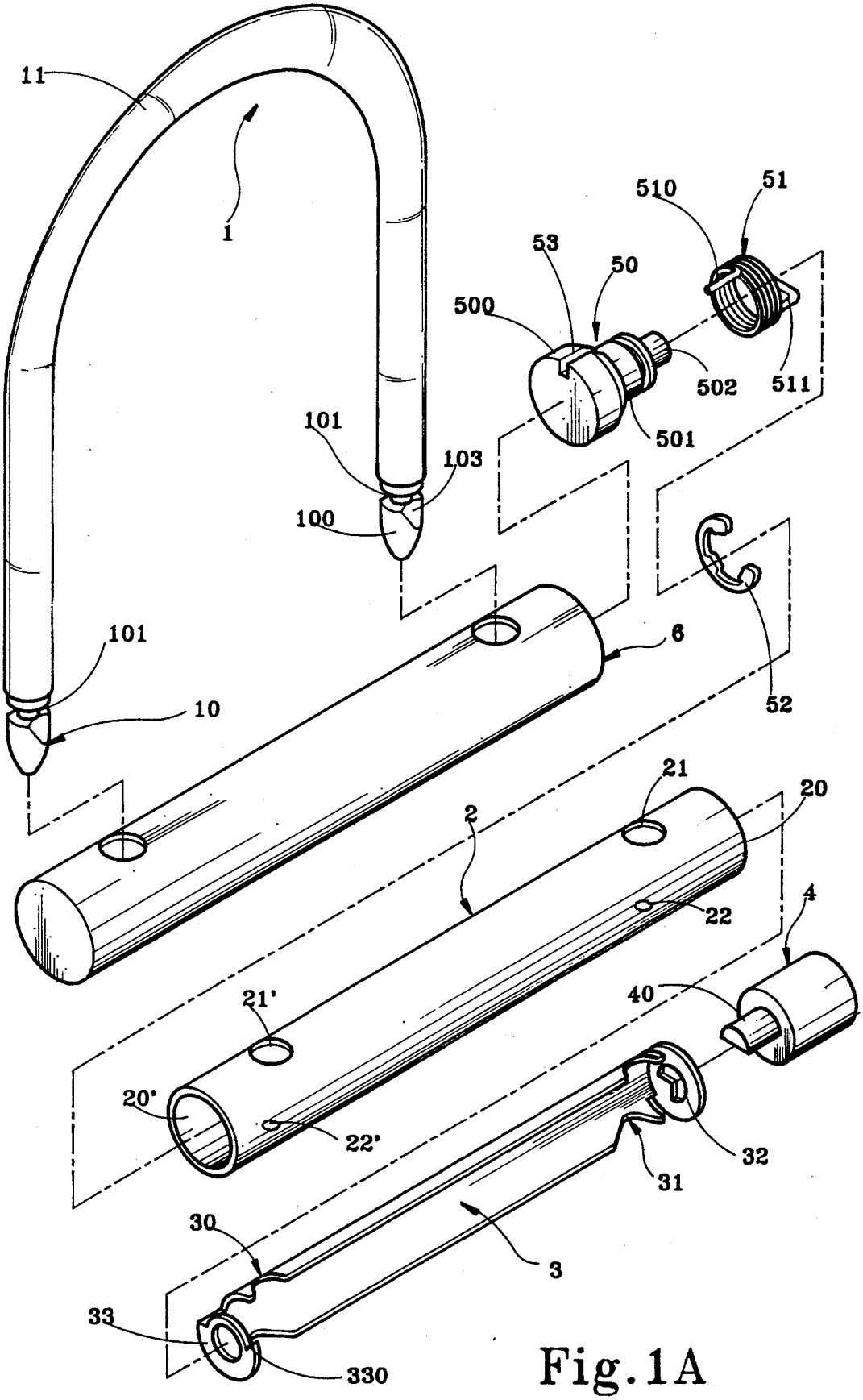
FIG. 1A is an exploded view of a bicycle lock according to the present invention.
Figure 1B:
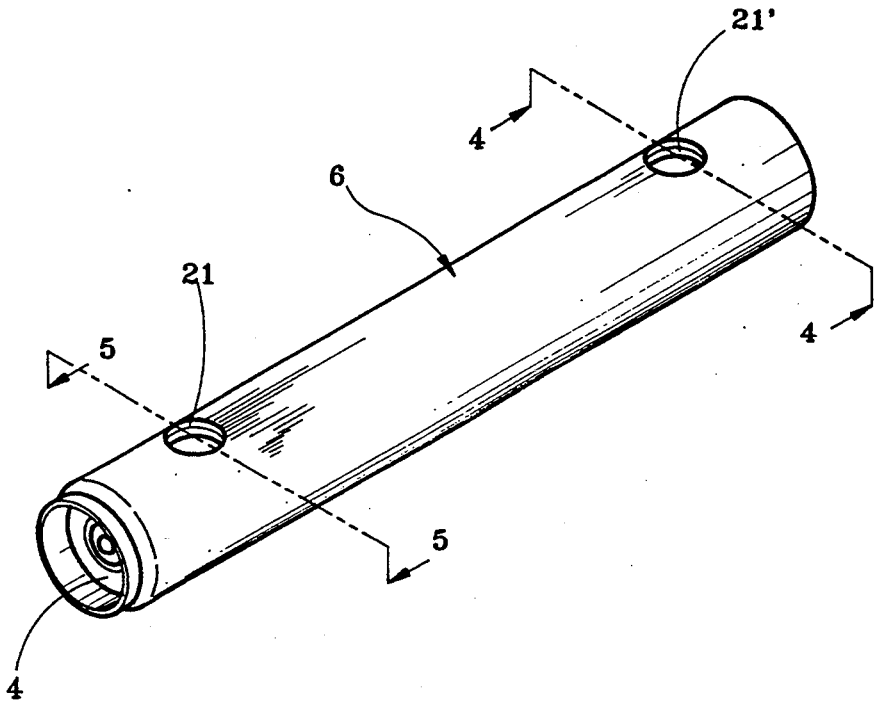
FIG. 1B is an elevational view of the lock body for the bicycle lock shown in FIG. 1A.

Referring to FIGS. 1A and 1B, a bicycle lock in accordance with the present invention is generally comprised of a shackle 1, which is made of steel in solid, a lock case 2, a shackle locking plate 3, a lock cylinder 4, and a constraint mechanism 5.

The shackle 1 comprises an elongated, curved shackle body 11, and two heads 10 at two opposite ends of the shackle body 11. When in use, the shackle body 11 is inserted through the wheel of the bicycle or motorcycle to be locked, and then the two heads 10 are respectively inserted into two openings 21 and 21' on the lock case 1 and locked in position.

Figure 3B:
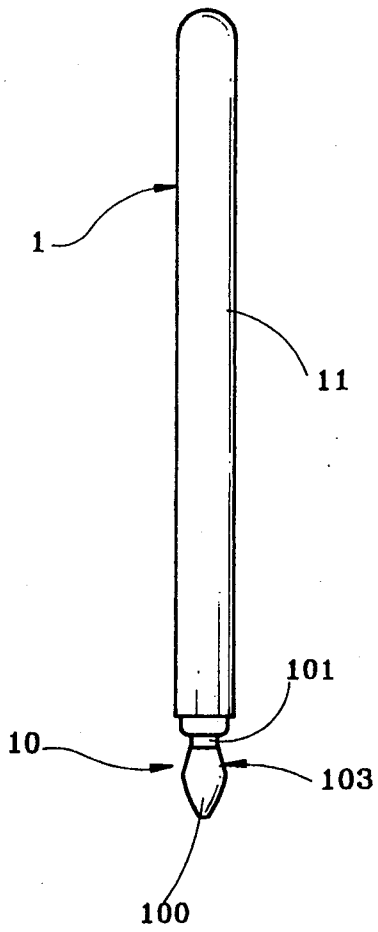
FIG. 3B is a side view of the shackle for the the bicycle lock shown in FIG. 1A.
Figure 3A:
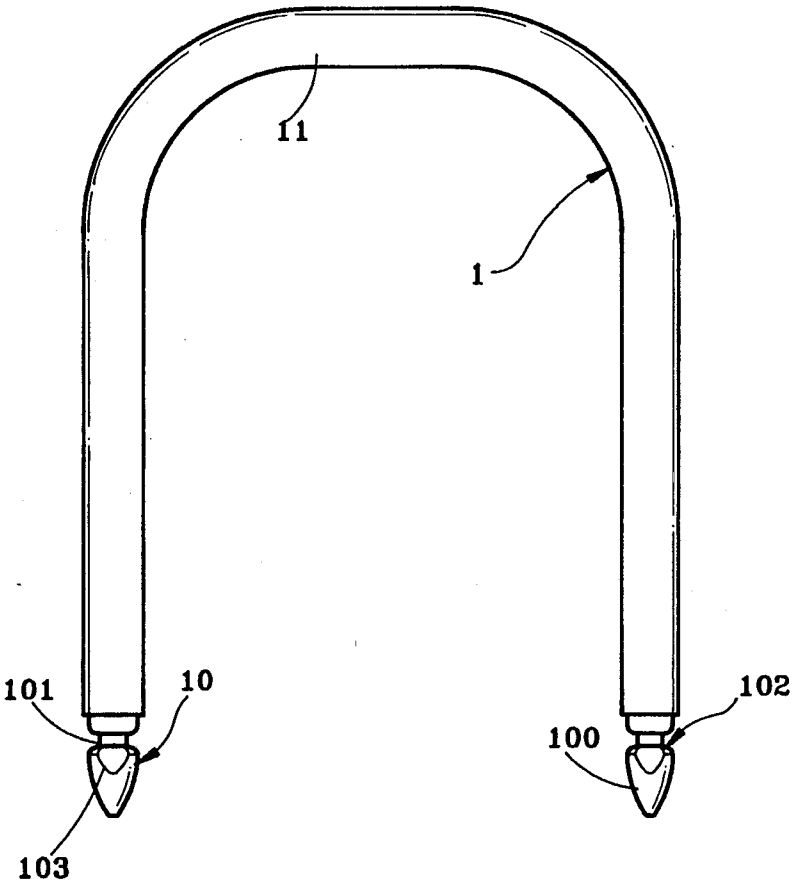
FIG. 3A is a front view of the shackle for the bicycle lock shown in FIG. 1A.

Referring to FIGS. 3A and 3B, the head 10 comprises a conical plug portion 100 shaped like the head of a bullet and a neck 101 longitudinally connected between the conical plug portion 100 and the shackle body 11. The conical plug portion 100 has a level section 102 connected to the neck 101, and two opposite slopes 103 downwards outwards extended from the connecting area between the level section 102 and the neck 101. The neck 101 is made of cylindrical shape in diameter relatively smaller than the level section 102. When the head 10 is inserted into either opening 21 or 21', the neck 101 is engaged by a respective shackle neck engaging portion 30 on the shackle locking plate 3, and therefore the shackle 1 is locked in position and cannot be removed from the lock case 2 (see FIGS. 7A and 7B). The arrangement of the aforesaid slopes 103 permits the head 10 to be smoothly moved away from the respective shackle neck engaging portion 30 when the bicycle lock is unlocked.

Referring to FIGS. 1A and 1B again, the lock case 2 is made from a hollow cylinder having two opposite open ends, namely, the front open end 20 and the rear open end 20' longitudinally aligned and communicated with each other. The lock case 2 has two openings 21 and 21' spaced at one side for inserting the heads 10 of the shackle 1 respectively, and two small holes 22 and 22' spaced at an opposite side and respectively aligned with the openings 21 and 21' for receiving the tip of either conical plug portion 100.

Figure 2A:
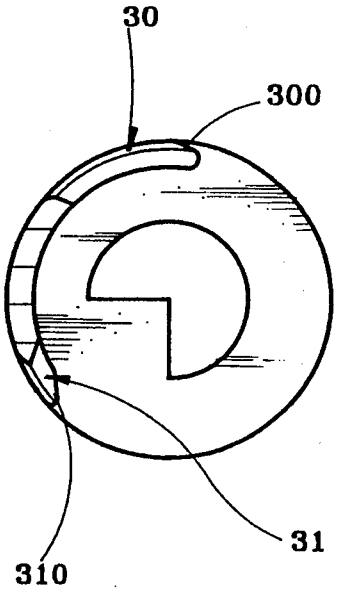
FIG. 2A is a cross section taken on line 2A—2A of FIG. 2B.
Figure 2B:
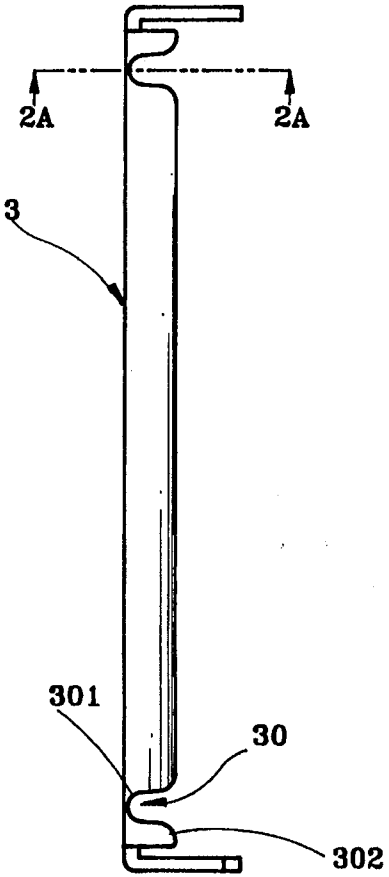
FIG. 2B is a plain view of the shackle Lock for the bicycle lock shown in FIG. 1A.

Referring to FIGS. 2A and 2B and FIGS. 1A and 1B again, the shackle locking plate 3 is received inside the lock case 2 and turned by the lock cylinder 4 to lock or unlock the shackle 1. The shackle locking plate 3 is made from an elongated plate of arched cross section, having two shackle neck engaging portions 30 spaced at one long side thereof for engaging the necks 101 of the shackle 1 respectively. The shackle neck engaging portion 30 comprises an arched bottom 301, and a horn-like peripheral edge 302 extended outwards from the arched bottom 301. By means of the arched bottom 301, the shackle neck engaging portion 30 can hold down the neck 101. As shown in FIG. 2A, there is a sloping guide surface 300 made on the top of the shackle neck engaging portion 30 gradually downwards smaller toward the center of the shackle neck engaging portion 30 for guiding the respective conical plug portion 100 into the locking position. The shackle locking plate 3 further comprises two release portions 31 spaced at an opposite long side thereof corresponding to the shackle neck engaging portions 30. The release portion 31 is an arched notch having a sloping surface 310. When the shackle locking plate 3 is turned from the locking position to the unlocking position to release the shackle neck engaging portions 30 from the necks 101 of the shackle 1, the two release portions 31 of the shackle locking plate 3 are simultaneously respectively moved to the bottom of either conical plug portion 100 causing the sloping surface 310 to move against the bottom of the respective conical plug portion 100, and therefore the two conical plug portions 100 are simultaneously lifted toward the openings 21 and 21'.

Figure 5:
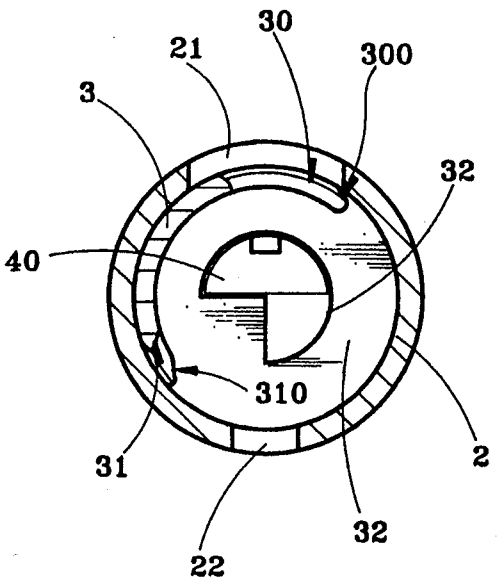
FIG. 5 is a cross sectional view taken along line 5—5 of FIG. 1B.
Figure 8:
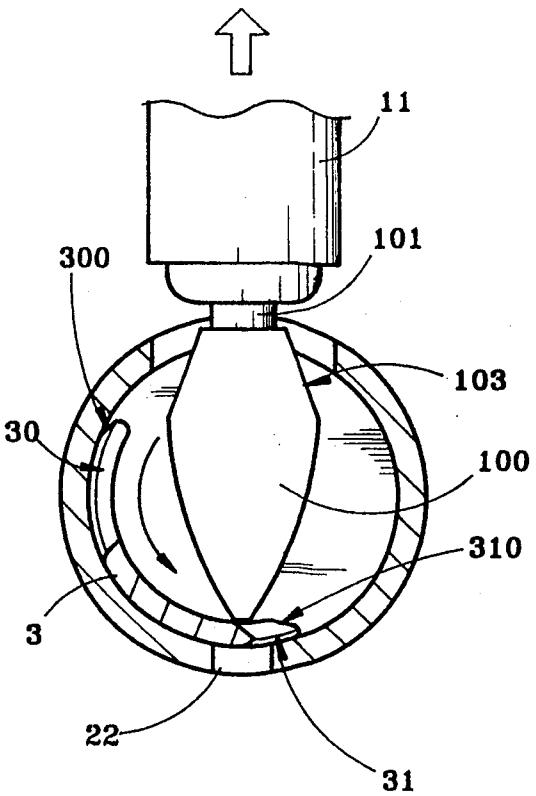
FIG. 8 is similar to FIG. 7B but showing the shackle locking plate turned from the locking position to the unlocking portion to push the conical plug portion upwards.
Figure 7B:
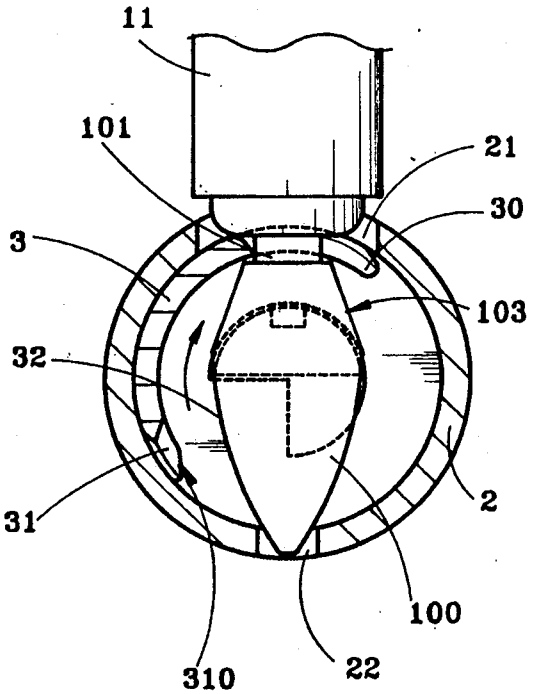
FIG. 7B is similar to FIG. 7A but showing the conical plug portion completely inserted into the lock case and locked in the locking position.
Figure 7A:
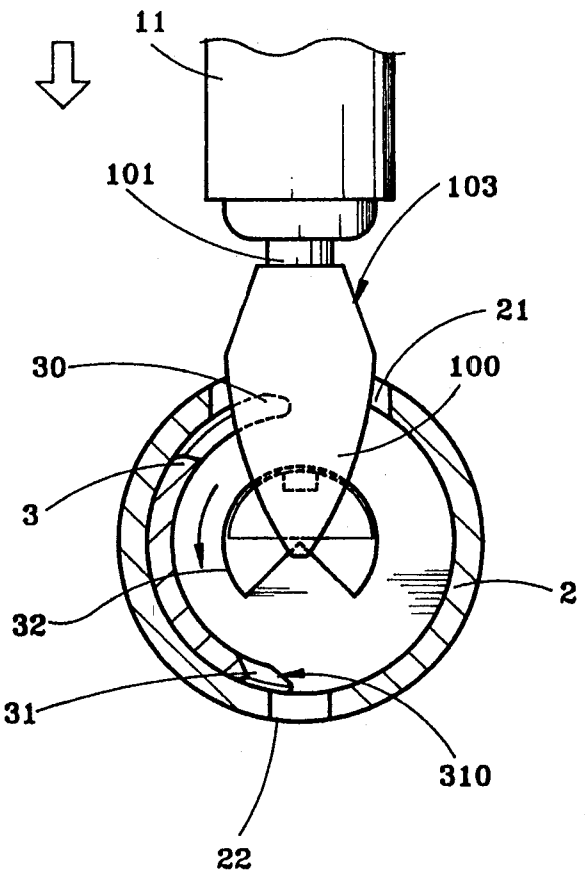
FIG. 7A is a schematic drawing showing the conical plug portion partially inserted into the lock case according to the present invention.

The aforesaid lock cylinder 4 is mounted within the front open end 20 of the lock case 2, having a half-round spindle 40 fitted into a coupling hole 32 on the shackle locking plate 3 at one end. When the shackle 1 is locked in the locking position as shown in FIG. 7B, the shackle neck engaging portions 30 engage the necks 101 of the shackle 1 respectively causing the openings 21 and 21' blocked. When locked, the position of the half-round spindle 40 of the lock cylinder 4 is as shown in FIG. 5.

Figure 6:
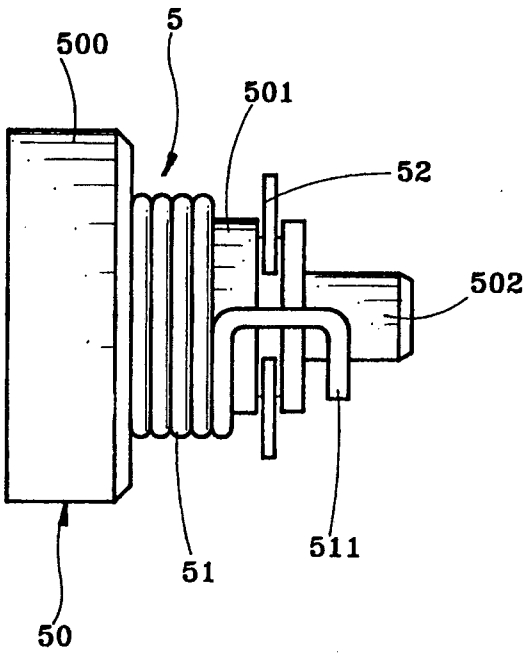
FIG. 6 is a side view in plain of the constraint mechanism for the bicycle lock shown in FIG. 1A.
Figure 4:
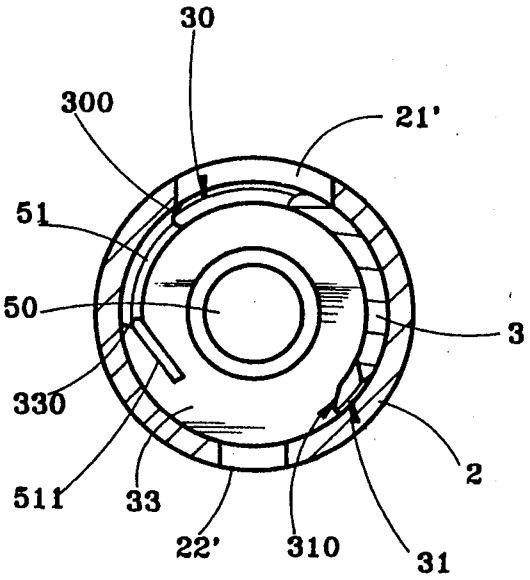
FIG. 4 is a cross sectional view taken along line 4—4 of FIG. 1B.

Referring to FIGS. 4 and 6 and FIG. 1A again, the constraint mechanism 5 is mounted within the rear open end 20' of the lock case 2 to hold the shackle locking plate 3 and the half-round spindle 40 of the lock cylinder 4 in the locking position. The constraint mechanism 5 comprises a headed locating bolt 50, a spiral spring 51, and a clamp 52. The locating bolt 50 comprises a bolt body 501 having a head 500 at one end fitted into the rear open end 20' of the lock case 2 and a front extension rod 502 disposed inside thee lock case 2 and coupled to a coupling portion 33 of the shackle locking plate 3. The clamp 52 is fastened to the bolt body 501 of the locating bolt 50. The spiral spring 51 is mounted around the bolt body 501 of the locating bolt 50 and retained between the head 500 and the clamp 52, having a fixed end 510 inserted into a notch 53 on the head 500 and a free end 511 hooked on a cut 330 on the coupling portion 33 of the shackle locking plate 3. When locked, the spiral spring 51 is slightly twisted to provide a turning force to the shackle locking plate 3 causing the shackle neck engaging portions 30 of the shackle locking plate 3 maintained in the locking position as shown in FIG. 4.

The operation of the bicycle lock of the present invention will now be outlined hereinafter.

1) Under normal conditions, the arched bottom 301 of each shackle neck engaging portion 30 passes over the center of the respective opening 21 or 21', the release portions 31 do not block the small holes 22 and 22'.

2) During the insertion of the heads 10 of the shackle 1 into the openings 21 and 21' on the lock case 2, the shackle neck engaging portions 30 touch the conical surface of either conical plug portion 100, and therefore the shackle locking plate 3 is turned through a certain angle when the heads 10 of the shackle 1 are continuously inserted into the openings 21 and 21'. Because the coupling hole 32 is a $\frac{3}{4}$ round opening, the half-round spindle 40 does not change its position when the shackle locking plate 3 is turned by the heads 10 of the shackle 1 (see FIG. 7A).

3) When the heads 10 of the shackle 1 are completely inserted into the openings 21 and 21' (see FIG. 7B), the arched bottom 301 of each shackle neck engaging portion 30 respectively engages either neck 101 of the shackle 1 to hold down the shackle 1 in the locking position, and at the same time the bottom end of each conical plug portion 100 respectively engages either small hole 22 or 22'. Therefore, the heads 10 of the shackle 1 respectively contact the lock case 2 at two vertically spaced contact points. This arrangement protects the shackle 1 against vibration. Furthermore, if the shackle 1 is shaken sideways, the slopes 103 on each arched plug portion 100 will normally contact the peripheral edge of the respective shackle neck engaging portion 30 causing a normal stress to overcome the force of shaking. Therefore, the shackle 1 will not be vibrated.

4) When the key is inserted into the lock cylinder 4 to turn the spindle 40, the shackle neck engaging portions 30 of the shackle locking plate 3 will be moved away from the necks 101 of the shackle 1 and at the same time, the release portions 31 will be moved to the conical plug portions 100 causing the sloping surface 310 of each release portion 31 to force either conical plug portion 100 upwards toward the respective opening 21 or 21'. When the shackle locking plate 3 is turned, the spiral spring 51 is twisted. Therefore, when the shackle 1 is removed from the lock case 2, the spiral spring 51 is released, causing the shackle locking plate 3 returned to its former position.

Referring to FIG. 1A again, there is an elastic protective covering 6, preferably made of rubber, covered over the lock case 2. The protective covering 6 must be so made that the openings 21 and 21' and the lock cylinder 4 are exposed to the outside for operation. Similarly, the shackle 1 may be covered with an elastic protective covering.

I claim:

1. A bicycle lock comprising a cylindrical lock case having two openings spaced at one side, a shackle locking plate revolvably received inside said lock case, a constraint mechanism fastened to said lock case at one end to hold said shackle locking plate in the locking position, a lock cylinder fastened to said lock case at an opposite end and controlled to turn said shackle locking plate between the locking position and the unlocking position, and a shackle having two heads at two opposite ends of a shackle body thereof respectively inserted into the openings on said lock case and locked by said shackle locking plate;

each head of said shackle including a conical plug portion for inserting into either opening on said lock case, a neck longitudinally connected between a respective said conical plug portion and said shackle body for locking by said shackle locking plate, said conical plug portion having a section connected to said neck, and two opposite slopes extending from the connecting area between said section and said neck, said neck being smaller in diameter than said section;

said lock case having two spaced small holes respectively for alignment with the openings of said lock case for receiving an end of a respective said conical plug portion, the diameter of the small holes being smaller than that of the openings;

said shackle locking plate including two shackle neck engaging portions spaced at one side for engaging the necks of said shackle, and two release portions spaced at an opposite side for pushing said conical plug portions toward the openings on said lock case; and said constraint mechanism including a headed locating member fixed to said lock case at one end, a spiral spring mounted around said headed locating member, and a clamp fastened to said headed locating member to stop said spiral spring against axial movement, said spiral spring having one end attached to said headed locating member and an opposite end hooked on one end of said shackle locking plate for keeping said shackle locking plate at the locking position.

2. The bicycle lock of claim 1 wherein the two opposite slopes of the conical plug portion of either head of said shackle are disposed corresponding to either shackle neck engaging portion so that, when said shackle neck engaging portions disengage from either neck of said shackle, said shackle neck engaging portions pass through the slopes of either conical plug portion.

3. The bicycle lock of claim 1 wherein each shackle neck engaging portion of said shackle locking plate comprises an arched bottom for engaging either neck of said shackle, and a peripheral edge extends outwards from said arched bottom.

4. The bicycle lock of claim 1 or 3 wherein each shackle neck engaging portion of said shackle locking plate has a sloping guide surface made gradually smaller toward the center for guiding a respective said conical plug portion into the locking position.

5. The bicycle lock of claim 1 wherein said release portions of said shackle locking plate comprise each an arched notch facing either shackle neck engaging portion, and a sloping surface for pushing the respective conical plug portion toward the respective opening on said lock case.

6. The bicycle lock of claim 1 wherein when said shackle is removed from said lock case, said shackle neck engaging portions partially block said openings of said lock case and, said release portions are moved away from said small holes on said lock case.

* * * * *